United States Patent [19]

Biro

[11] 4,257,202

[45] Mar. 24, 1981

[54] ALUMINUM FRAME WINDOW WITH IMPROVED THERMAL INSULATION AND METHOD OF MAKING SAME

[75] Inventor: Alexander J. Biro, Indiana, Pa.

[73] Assignee: Armcor Industries, Inc.

[21] Appl. No.: 666,511

[22] Filed: Mar. 10, 1976

[51] Int. Cl.[3] ..... E06B 1/32

[52] U.S. Cl. ..... 52/204; 52/403

[58] Field of Search ..... 52/204, 403; 49/DIG. 1, 49/504

[56] References Cited

U.S. PATENT DOCUMENTS

| | | | |
|---|---|---|---|
| 3,393,487 | 7/1968 | Nolan | 49/DIG. 1 |
| 3,420,026 | 1/1969 | Nolan | 49/DIG. 1 |
| 3,780,473 | 12/1973 | Kort | 49/DIG. 1 |
| 3,818,666 | 6/1974 | Winans | 52/403 |
| 3,925,953 | 12/1975 | LaBorde | 52/403 X |

*Primary Examiner*—J. Karl Bell

*Attorney, Agent, or Firm*—Ira C. Edell

[57] ABSTRACT

A thermal break in a metal (e.g. aluminum) frame window or door is characterized by two spaced metal sections joined together by an insulative block of poured and hardened thermal fill material which projects inward toward the sash at least to the same extent as the inward-most-projection of the metal sections in the break region. One or more surfaces of the block may serve as a guide for a sliding sash. This construction eliminates the metal conductive path, from outside to inside, which extends along inward-most portions of the jamb in prior art windows. Preferably, the thermal breaks in the jamb and sill are co-planar to provide a continuous thermal break around the entire frame. The method of forming the block of thermal fill utilizes at least one mold surface to which the fill material does not adhere during hardening so that the block can be easily removed from the mold.

7 Claims, 10 Drawing Figures

FIG.1
(PRIOR ART)
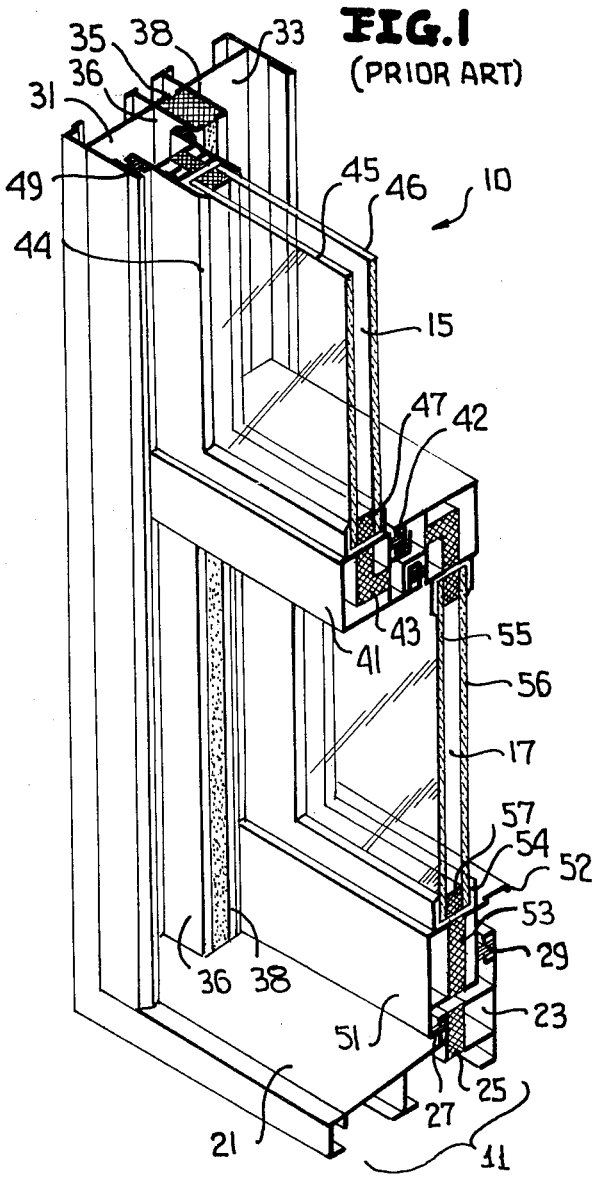
FIG.2
(PRIOR ART)
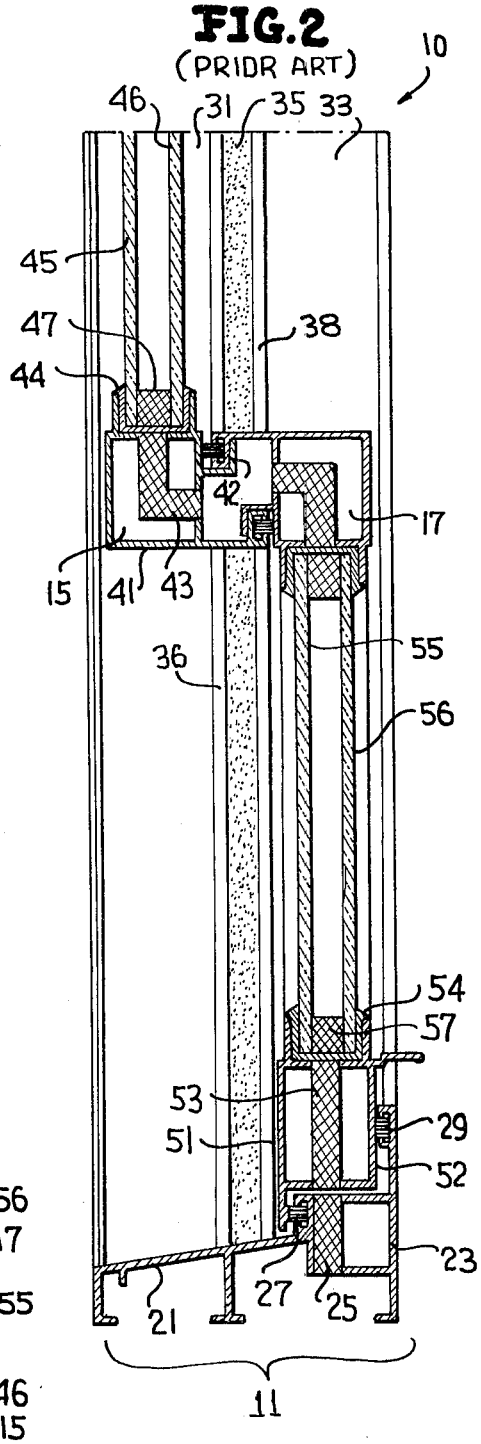
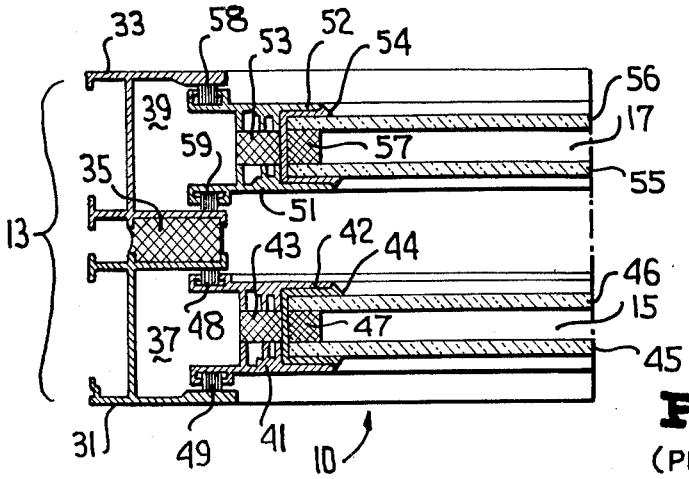
FIG.3
(PRIOR ART)

ALUMINUM FRAME WINDOW WITH IMPROVED THERMAL INSULATION AND METHOD OF MAKING SAME

BACKGROUND OF THE INVENTION

The present invention relates to methods and apparatus for eliminating thermal conduction between the exterior and interior surfaces of metal frame windows and doors, particularly aluminum frame windows and doors.

Although the preferred embodiment of this invention is described in relation to a double-hung aluminum frame window, it is to be understood that the principles described herein apply to other types of aluminum or metal windows as well as a variety of metal door structures.

A well-recognized problem concerning aluminum frame windows and doors relates to the high thermal conductivity of aluminum. The symptoms of the problem are twofold: (1) the thermal conductivity of the aluminum frame results in losses and inefficient heating or cooling of the premises interior; and (2) in cold weather there is considerable condensation on the inside of the aluminum frame, resulting in considerable mess and water damage to walls, floors, curtains, etc. There have been a number of prior art approaches to solving this problem, the most effective of which uses a thermal barrier poured to join the outside and inside frame sections. Examples of this approach are found in U.S. Pat. No. 3,204,324 to Nilsen, and U.S. Pat. No. 3,818,666 to Winans. In the Nilsen patent an extruded aluminum member is provided with a three-sided channel which is filled with a molten polyester resin of a type which is allowed to harden and adhere to the inside channel walls. Thereafter the bottom channel wall is removed by an appropriate machining process, leaving two aluminum members joined by the rigid, thermally-insulative resin. Industrial experience has proven the machining step for removal of the bottom channel wall to be an expensive and time-consuming part of the frame fabrication procedure. In addition, the resulting inside and outside frame members must be the same color, a factor which is undesirable from a consumer product viewpoint. The reason for the same color requirement is that the resulting thermally-insulated members cannot be subjected to the high temperatures required for surface curing without destroying or structurally impairing the thermal fill material. Consequently, the two frame members must remain the same color as the original single frame member.

The Winans patent recognizes the aforementioned disadvantages of the Nilsen approach and offers a structure which is formed from two individual aluminum members. The two members are placed in a jig with spaced side walls of each member forming respective sides of a channel to be filled. A U-section vinyl bridge is placed around the channel so that the base of the bridge defines the bottom of the channel and the sides of the bridge engage the outside surfaces of the channel side walls. The channel is then filled with molten resin material, as in Nilsen, and allowed to harden. Winans' approach eliminates some of the problems inherent in the Nilsen approach but not all, and it also introduces other problems. For example, Winans recesses the thermal break joint into the window jamb, so that both sides of the track for the window sash are aluminum. Therefore, in a double-hung window, one side of the aluminum track must communicate between the exterior and interior of the premises, even when the window is closed. This problem is more clearly described in the Background section hereof in relation to prior art FIGS. 1–3. The result is that a thermally conductive aluminum path communicates between the premises exterior and interior and thereby largely negates the insulative effect of the thermal break. This same problem exists in the Nilsen approach. Further, in Winans the bridge member must include projections which extend into the bottom of the filled channel to assure that the vinyl bridge remains secured to the hardened thermal fill material. Winans states that the vinyl bridge can be stripped away after the fill hardens or can be left on. In either case, the vinyl bridge is considerably more expensive than the fill material and adds considerably to the expense of the manufacturing process. This is true because even if the bridge is stripped away it cannot be re-used because the projections from the bridge into the channel must be severed during the stripping.

It is an object of the present invention to provide an aluminum frame window or door and a method for fabricating same which eliminates the aforementioned problems.

It is an object of the present invention to provide an inexpensive thermal break having improved insulating efficiency.

It is another object of the present invention to provide a method for simply and efficiently fabricating an improved thermal break.

SUMMARY OF THE INVENTION

A thermal break according to the present invention employs insulative fill material in the form of a block projecting toward the sash so that fill material and not metal is exposed to both the exterior and interior environment. Consequently, in the preferred double-hung window embodiment, it is the insulative fill material and not the thermally-conductive aluminum sidewalls which defines one side of each sash track. In addition, the sill is formed in two aluminum parts using fill material to join the parts and a vinyl bridge member extending along the top surface of the sill joint. The thermal break in the jamb is positioned co-planar with a thermal break in the sill so that a continuous insulative joint extends around the frame.

In fabricating the thermal break a jig is employed to properly position the two aluminum members. The jig, in the region of the poured fill material, is lined with a substance to which the fill material does not adhere. Alternatively, a jacket made of that substance is inserted in the jig and defines the fill mold cavity, the jacket being removable from the mold after the mold hardens. In either case a snug-fitting decorative vinyl cover may be placed over the exposed hardened fill material, if desired, for appearance purposes.

BRIEF DESCRIPTION OF DRAWINGS

The above and still further objects, features and advantages of the present invention will become apparent upon consideration of the following detailed description of one specific embodiment thereof, especially when taken in conjunction with the accompanying drawings, wherein:

FIG. 1 is a partial sectional view in perspective of a prior art aluminum frame window;

FIG. 2 is a partial side view in longitudinal section of the window of FIG. 1;

FIG. 3 is a partial top view in transverse section of the window of FIG. 1;

DESCRIPTION OF PREFERRED EMBODIMENTS

Figure 4:
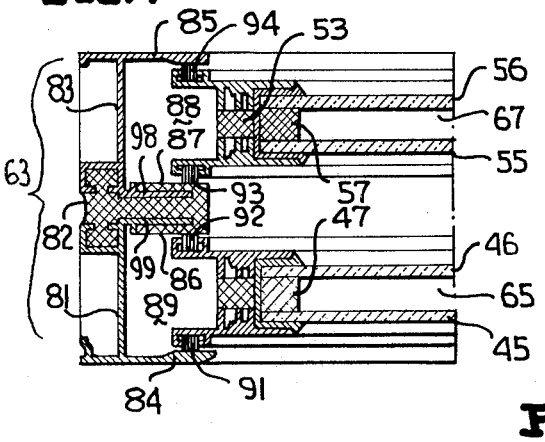
FIG. 4 is a view similar to FIG. 3 of an aluminum frame window according to the present invention.

Referring specifically to FIGS. 1 through 3 of the accompanying drawings, a conventional prior art double-hung aluminum frame window 10 is illustrated. Window 10 includes a sill 11 and jamb 13. Upper sash 15 and lower sash 17 are vertically slidable in respective tracks defined in jamb 13, the lower sash 17 being slidable along the track on the interior (i.e. interior of the premises) side of window 10. For purposes of the description set forth herein, the term interior shall refer to the side of window 10 exposed to the interior of the premises; the term exterior shall refer to the side of window 10 exposed to the exterior of the premises.

Sill 11 includes an exterior aluminum section 21 and an interior aluminum section 23, the two sections being spaced from one another by a thermal break 25 to which members 21 and 23 are firmly secured. Thermal break 25 is made from a suitable thermally-insulative material such as a polyester resin which is poured in liquid form into a mold and allowed to harden while adhering to sill members 21 and 23. Members 21 and 23 further include the usual weatherstrip 27 and 29, respectively, which abut the lowermost portions of lower sash 17 when that sash is in its lowermost or closed position.

Jamb 13 includes an aluminum exterior member 31 and an aluminum interior member 33 joined together by thermal break 35. A vertical track 37 for upper sash 15 is defined along exterior member 31; a vertical track 39 for lower sash 17 is defined along interior member 33. As is conventional, thermal break 35 is made of the same material as thermal break 25 and is located entirely within a channel defined by aluminum parting strips 36, 38 of exterior and interior members 31, 33, respectively.

Exterior sash 15 includes an exterior frame member 41 and interior frame member 42 joined together by a thermal break 43. A U-shaped recess defined by members 41 and 42 and thermal break 43 receives a vinyl glazing channel member 44 which holds two insulated glass panes 45, 46 spaced from one another by insulative spacer 47. A weather strip 48 is engaged by interior frame member 42 to abut and ride along aluminum partition strip 36 in channel 37. Similar weather stripping abuts and is engaged by exterior frame member 41 to abut the opposite wall of channel 37.

Lower sash 17 is constructed similarly to sash 15. Exterior frame member 51 and interior frame member 52 are joined by a thermal break 53. A U-shaped recess between members 51, 52 and thermal break 53 receives a vinyl glazing channel in which panes 55 and 56 are supported and spaced by insulative spacer 57. Weather stripping 58, 59 abuts the aluminum sidewalls of track 39.

Constructed in accordance with conventional prior art techniques, jamb 13 is formed by utilizing a single extrusion from which members 33 and 31 are formed by stripping away metal which joins these members after fill material 35 hardens. Considering prior art window 10 in its closed position as shown in FIGS. 1, 2 and 3, it is readily noted that the sides 36, 38 of the aluminum parting strip are exposed to the outside at the bottom half of the window and to the inside at the top half of the window. Therefore, a direct aluminum thermal path communicates between the premises exterior and interior. The insulative effect of thermal break 35, and all of the other thermal breaks in window 10 for that matter, is thwarted. Apart from the fact that parting strip sides 36, 38 are directly exposed to the outside environment, it is noted that both sides are in thermal contact with exterior aluminum sill member 21 which further aids in thermal transfer between the outside and inside environments via the parting strips. An important aspect of the present invention is the elimination of these thermal loss conduction paths, inexpensively.

Figure 5:
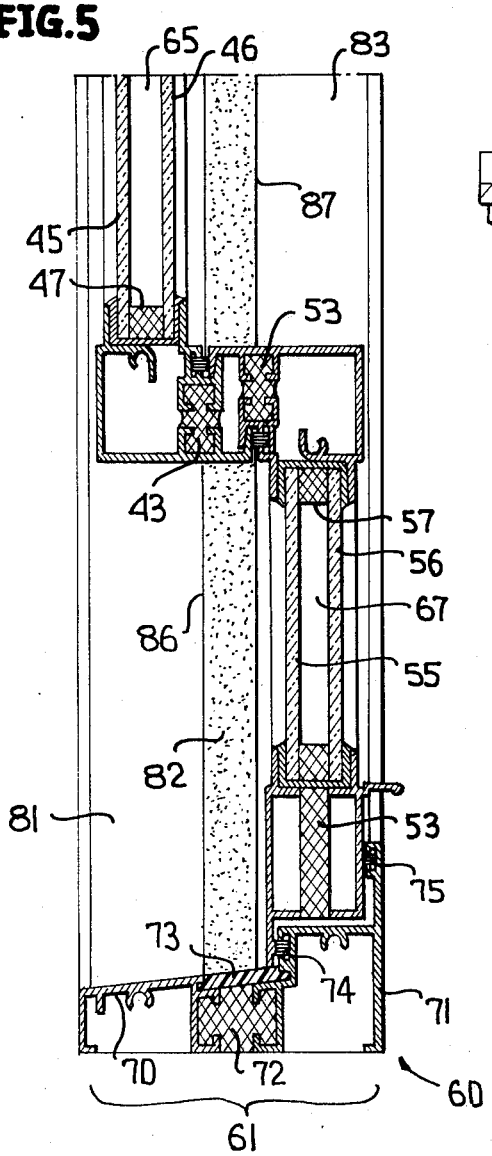
FIG. 5 is a view similar to FIG. 2 of the aluminum frame window of FIG. 4.

Referring to FIGS. 4 and 5, a window 60 constructed in accordance with the present invention includes a sill 61, jamb 63, upper sash 65 and lower sash 67. Sill 61 includes an exterior aluminum section 70 and an interior aluminum section 71 joined together by a thermal break. The thermal break includes at its bottom the usual thermal fill material 72 topped by a rigid polyvinylchloride (PVC) insert 73. The top surface of insert 73 is co-planar with the top surface of section 70 to provide a continuous sill surface. The PVC insert may be eliminated, if desired, leaving only the fill material which would then have to extend into co-planar relation with the top surface of section 70. If used, insert 73, like fill material 72, is thermally insulative and forms part of the thermal break between exterior sill section 70 and interior sill section 71. The method of fabricating this thermal break is described subsequently in relation to FIG. 6. Interior sill section 71 has the usual weather stripping 74, 75 secured thereto and arranged to weather-seal the window when lower sash 67 is fully down or closed.

Jamb 63 includes an exterior aluminum member 81 and an interior aluminum member 83 joined together by a thermal break. The thermal break comprises thermal fill material 82 entirely surrounding the portions 98, 99 of members 81 and 83 which project toward sashes 65 and 67. The thermal fill material extends along the entire vertical length of the window from PVC insert 73 on sill 61 to a similar thermally insulative insert at the top part of the window frame (not shown). A track 89 for upper sash 65 is defined between the exterior wall 84 of member 81 and outward-facing wall 86 of thermal break 82. A track for the lower sash 67 is defined between the interior wall 85 of member 83 and the inward-facing wall 87 of thermal break 82. Importantly, the thermal break (not aluminum members) forms the parting strip between sashes 65 and 67 and provides one side of each of tracks 88 and 89. Therefore, weather strips 92 (on sash 65) and 93 (on sash 67) combine with the thermal break 82 to preclude any thermally conductive path from the outside to inside, such as the paths provided by parting strip sides 36 and 38 in FIGS. 1-3. Additional weather stripping 94 (on sash 67) and 91 (on sash 65) ride along walls 85 and 84, respectively, of the tracks. The method of forming thermal break 82 is described subsequently in reference to FIGS. 7-10.

It is to be noted that the bottom of thermal break 82 rests on thermally insulative PVC insert 73 at the thermal break in sill 61. Therefore, there is no thermally conductive path from the exterior sill section 70 to the aluminum projections 98, 99 embedded in the fill material 82.

The sashes 65 and 67 are basically similar to sashes 15 and 17, and like parts are referenced by the same numerals.

Figure 6:
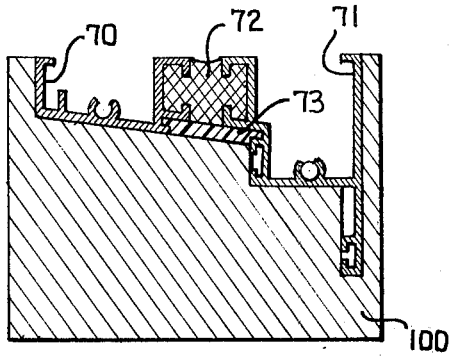
FIG. 6 is a sectional view of the sill structure for the window of FIG. 4 and a jig in which the sill structure is formed.

The method of fabricating sill 61 is illustrated in FIG. 6. The two extruded aluminum sections 70 and 71 are placed in a specially contoured jig 100 spaced by PVC insert 73. The components 70, 71 and 73 are placed upside-down relative to their position in window 60 so that PVC insert 73 forms the bottom of a channel defined between sections 70 and 71. With the positions of sections 70, 71 thus fixed by jig 100 and insert 73, the molten thermal fill material 72 is poured into the thusly formed channel and allowed to harden. In hardening the fill material adheres to the aluminum sidewalls of sections 70, 71 and to the PVC insert 73 to form a strong, rigid and thermally insulative joint or break in the sill 61.

Figure 7:
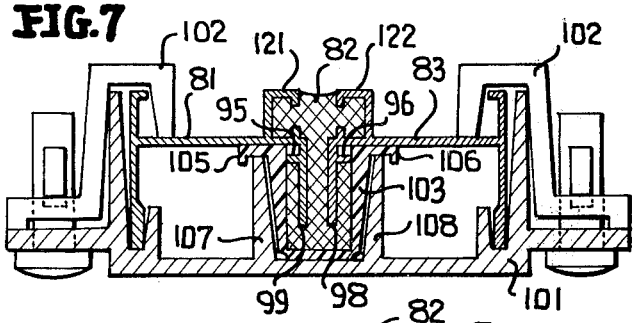
FIG. 7 is a sectional view illustrating one step of a method of fabricating a thermal break according to the present invention.
Figure 8:
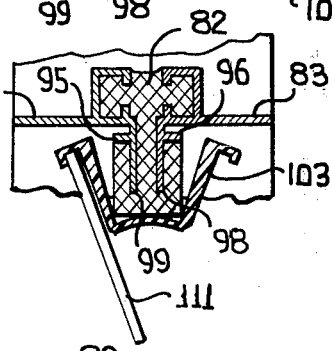
FIG. 8 is a sectional view illustrating a method step subsequent to that illustrated in FIG. 7.

One method of fabrication of the thermal break 82 in jamb 63 is illustrated in FIGS. 7 and 8. A two-piece jig arrangement including a bottom jig section 101 and top jig section 102 is employed. A center region of lower jig section 101, in which the thermal break is formed, is fitted with a re-usable jacket 103 having a generally rectangular or U-shaped cross-sectional channel. The jacket 103 is made of polypropylene or teflon or some other material to which the fill material 82 does not adhere during hardening. Jacket 103 includes outer rims 105, 106 which extend across its length and rest on respective supports 107, 108 extending upwardly from the bottom of lower jig section 101. The upper surfaces of rims 105, 106 serve as supports for portions of jamb sections 81, 83. The jamb sections 81, 83 are placed in the specially contoured lower jig section so that projections 98, 99 extend downwardly into the U-shaped interior channel of jacket 103 with projections 98 and 99 being spaced from one another. Horizontally-extending projections 95 and 96 project from projections 81 and 83, respectively, to abut respective sidewalls of the jacket channel. With members 81 and 83 thusly in place the top jig section 102 is placed in position to secure the members against vertical movement. Thereafter the molten thermal fill is poured into the space between members 81 and 83, whereby it flows down around the bottom of projections 98 and 99 up to the level of horizontal projections 95 and 96. The fill 82 thus surrounds the metal projections 98, 99 within the channel of jacket 103. When the fill material 82 has hardened the jacket 103 is peeled away in any convenient manner, for example, in the manner shown in FIG. 8 wherein a simple bar 111 is inserted in a suitably provided flange in jacket 103 and pivoted so as to separate the jacket from the hardened fill 82. For such purposes the jacket 103 is made sufficiently flexible to facilitate its removal.

Figure 9:
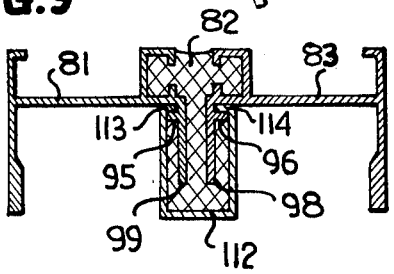
FIG. 9 is a sectional view illustrating one form of thermal break fabricated according to the present invention.

For some applications it may be desirable to employ decorative trim to cover the fill material 82. As illustrated in FIG. 9, this trim may take the form of a snap-on plastic cover 112 of generally U-shaped cross-section which fits around the rectangular fill material 82 and includes two inwardly projecting lips 113, 114 which engage projections 95, 96, respectively. Cover 112 is preferably made of PVC or other suitable insulative material which is preferably quite thin and flexible to reduce expense and facilitate its application to the fill material. The use of this decorative cover 112 is totally optional; importantly, however, it has no function in formation of the thermal break.

Figure 10:
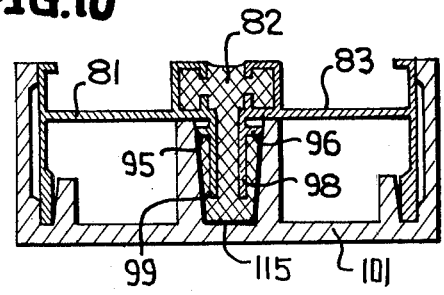
FIG. 10 is similar to FIG. 7 and illustrates an alternative method of fabricating a thermal break in accordance with the present invention.

It is possible to eliminate the need for jacket 103. This alternative method of thermal break fabrication is illustrated in FIG. 10. The lower jig section 101 is contoured to the desired shape of the thermal break, and the region of the jig section which comes into contact with fill material or is coated with teflon or other material to which fill 82 does not adhere while hardening. The method proceeds in the same manner described in relation to FIG. 7 except that there is no jacket to strip off after hardening of the fill material.

It is noted that the lower jig section 101 in FIG. 10 is tapered in the fill region, resulting in tapered sides for the hardened fill material 82. This is intended to simplify removal of the hardened fill material from the jig. Experiments have shown, however, that tapering is not required in most cases. Specifically, the teflon coating in the fill region of the jig has a sufficiently low coefficient of friction to permit the jig fill region to have parallel sides and still permit the parallel-sided thermal break to be readily removed.

The foregoing description sets forth an aluminum frame window, and the methods of making thermal breaks for that window, with the result that no thermal conduction paths appear in the final product and the window is simply and inexpensively made. Upon reading this disclosure certain modifications thereof will become apparent and it is the intention to incorporate such modifications herein. For example, the thermal break 82 may be employed in virtually any metal frame window or door and can be used in the threshold structure of a sliding door. It should also be noted that the fill material should be "keyed" or interlocked into the space between the two joined aluminum members in order to further secure the fill to the aluminum. For example, such keying is provided the "C"-shaped channels 121, 122 (FIG. 7) formed in the joined aluminum members 81, 83 and by utilizing different widths in the fill region.

While I have described and illustrated one specific embodiment of my invention, it will be clear that variations of the details which are specifically illustrated and described may be resorted to without departing from the true spirit and scope of the invention as defined in the appended claims.

I claim:

1. An aluminum frame doublehung window comprising:

a sill structure including:

exterior and interior spaced aluminum structural members having mutually facing portions, said exterior member having an exposed flat top surface which slopes downward in an outward direction;

a rigid thermally insulative insert extending between said exterior and interior members along the top of the space therebetween and having an exposed top surface which is co-planar with the flat top surface of said exterior member;

poured and hardened thermally insulative fill material filling the space below said insert between said mutually facing portions; and a sash member which in its closed position abuts said flat top surface of said insert.

2. The window according to claim 1 wherein the thermal break in said jamb is in contact with the top surface of said insert and has no direct contact with either of said exterior and interior members.

3. The window according to claim 1 further comprising a thin plastic snap-on trim member disposed over the thermal fill material in the jamb thermal break to cover at least said first and second block surfaces.

4. In a window according to claim 1, a jamb structure including a thermal break in a two-member jamb frame of the type in which adjacent portions of each jamb frame member are spaced by a poured and then hardened resinous thermally-insulative material block which is secured to the metal and which projects inwardly from the frame, said block having an inwardmost surface which is substantially parallel to said frame and wider than the minimum spacing between said members.

5. The window according to claim 4 wherein at least one of said two jamb frame members includes a projecting section which projects inwardly of said frame at said thermal break, and wherein said thermal break surrounds the extremity of said projecting section.

6. The window according to claim 4 wherein said two jamb frame members each include a projecting section which projects inwardly of said frame, the two projecting sections defining the minimum spacing between said frame members, and wherein said projections are embedded in and surrounded by said block.

7. In the aluminum frame doublehung window according to claim 11, a thermal break between first and second extruded aluminum jamb members, said thermal break comprising:

first and second metal projections projecting from said first and second members, respectively, toward the sash region of said window, said projections being adjacent to but spaced from one another;

a block of said fill material filling the space between said projections and extending further toward said sash region than at least one of said projections, said block surrounding at least a portion of said one projection on three sides, the block having first and second surfaces extending substantially the entire vertical length of said jamb members;

a first track for one window sash, said first track being formed between said first block surface and a surface of said first member;

a second track for a second window sash, said second track being formed between said second block surface and a surface of said second member; and weather stripping means between said first block surface and said one window sash, and between said second block surface and said second window sash.

* * * * *